US005151707A

United States Patent [19]

Kumpfbeck et al.

[11] Patent Number: 5,151,707

[45] Date of Patent: Sep. 29, 1992

[54] LINEAR ARRAY ANTENNA WITH E-PLANE BACKLOBE SUPPRESSOR

[75] Inventors: Richard J. Kumpfbeck, Lloyd Harbor; Peter W. Hannan, Smithtown, both of N.Y.

[73] Assignee: Hazeltine Corporation, Greenlawn, N.Y.

[21] Appl. No.: 636,752

[22] Filed: Jan. 2, 1991

Related U.S. Application Data

[60] Division of Ser. No. 339,883, Apr. 18, 1989, Pat. No. 5,111,214, which is a continuation of Ser. No. 917,743, Oct. 10, 1986, abandoned.

[51] Int. Cl.[5] ..... H01Q 1/280; H01Q 9/380; H01Q 9/420

[52] U.S. Cl. ..... 343/705; 343/826; 343/829

[58] Field of Search ..... 343/705, 708, 825, 826, 343/828, 829, 803, 815, 817, 818, 834, 789, 841

[56] References Cited

U.S. PATENT DOCUMENTS

| | | | |
|---|---|---|---|
| 2,594,871 | 4/1952 | Chu et al. | 343/841 |
| 2,691,102 | 10/1954 | Masters | 343/807 |
| 4,514,734 | 4/1985 | Cermignani et al. | 343/708 |
| 4,656,482 | 4/1987 | Peng | 343/705 |
| 4,864,319 | 9/1989 | Chen et al. | 343/835 |

FOREIGN PATENT DOCUMENTS

| | | | |
|---|---|---|---|
| 0027058 | 11/1968 | Japan | 343/914 |
| 0098553 | 8/1979 | Japan | 343/798 |
| 0150602 | 11/1980 | Japan | 343/713 |

*Primary Examiner*—Michael C. Wimer
*Assistant Examiner*—Peter Toby Brown
*Attorney, Agent, or Firm*—E. A. Onders

[57] ABSTRACT

An antenna comprising a linear array of active elements positioned in one or more rows. The back portion of the array is partially enveloped by a reflector. The reflector includes a backwall and at least one sidewall perpendicular to the backwall and extending forward of the backwall. In one embodiment of the invention, a single row of dipole radiators form the linear array. In a second embodiment of the invention, a row of folded monopoles mounted on an imaging ground plane form the linear array. The radiation pattern is directed forward of the reflector, the back radiation in the E-plane being suppressed by the sidewall of the reflector.

12 Claims, 3 Drawing Sheets

LINEAR ARRAY ANTENNA WITH E-PLANE BACKLOBE SUPPRESSOR

This application is a division of application Ser. No. 07/339,883 filed Apr. 18, 1989, now U.S. Pat. No. 5,111,214, which is a continuation of application Ser. No. 06/917,743 filed Oct. 10, 1986, now abandoned.

BACKGROUND OF THE INVENTION

1. Field of the Invention

This invention relates to electromagnetic antennas and, more particularly, to an antenna of active radiating elements arranged in a linear array and having structure behind the linear array to minimize backlobe and sidelobe radiation.

2. Description of the Prior Art

Backlobe and sidelobe suppression structures are well known in the prior art. However, such structures have been used with limited success in combination with linear array antennas. In particular, many linear array antennas develop undesirable backlobes and sidelobes in the E-plane. In general, the prior art has attempted to minimize these undesirable backlobes and sidelobes by passive directing or reflecting elements that are parallel to an active element such as used in Yagi antennas, or by a reflecting plane having a large E-plane dimension.

SUMMARY OF THE INVENTION

The backlobe and sidelobe problems mentioned above are overcome and other advantages are provided by an antenna system according to the invention. Such a system includes a radiation suppressor having a backwall and sidewalls extending forward of the backwall. A plurality of radiating elements are positioned in front of the backwall forming a linear array parallel to the backwall. Means are provided for feeding energy individually to each of said radiating elements. The sidewalls of the radiation suppressor are perpendicular to the elements and extend forward toward the plurality of radiating elements to suppress back radiation emitted in the E-plane by the plurality of radiating elements.

For a better understanding of the present invention, together with other and further objects, reference is made to the following description, taken in conjunction with the accompanying drawings, and its scope will be pointed out in the appended claims.

DETAILED DESCRIPTION OF THE INVENTION

Figure 1:
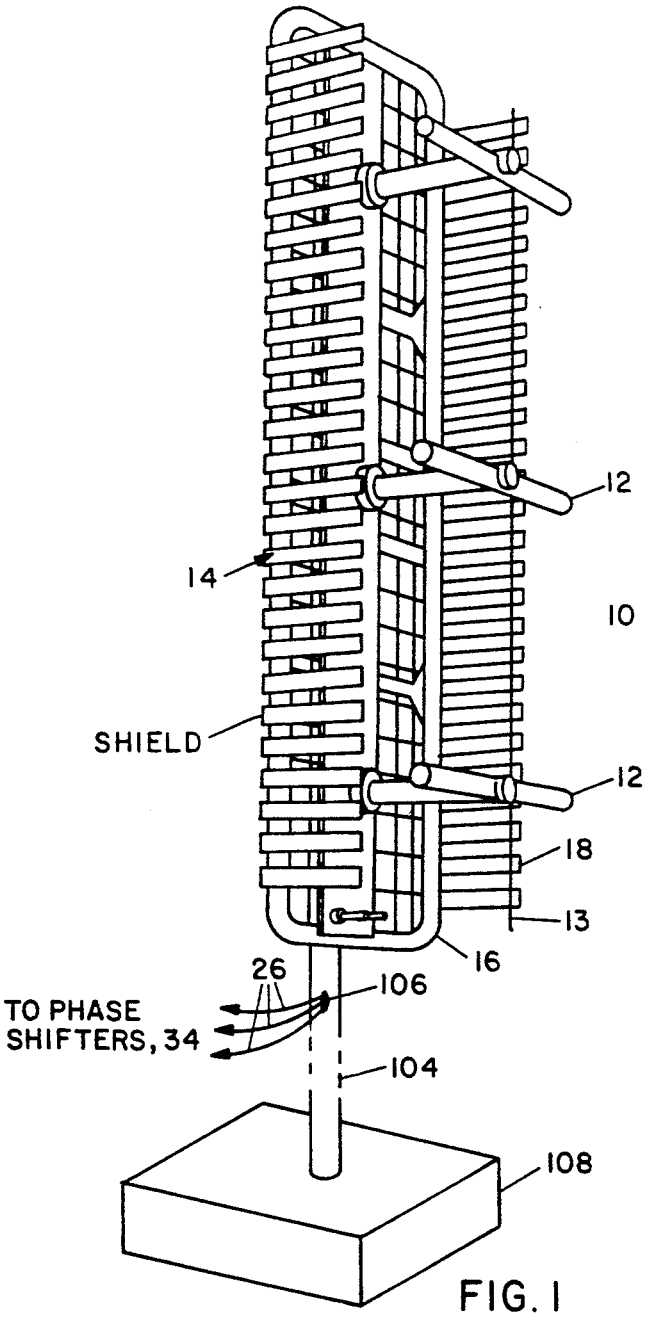
FIG. 1 is a perspective view of the first embodiment of the invention applying dipole radiators in front of a reflector which suppresses radiation in the reverse direction.

FIG. 1 shows a first embodiment of an antenna 10 of the invention. The antenna 10 comprises a set of dipole radiators 12 arranged as a linear array along axis 13.

Dipoles 12 are positioned one above the other in front of a reflector 14 which serves as a shield to inhibit propagation of radiation from the radiators 12 to points behind the antenna 10. The reflector 14 comprises a backwall 16 with a pair of sidewalls 18 extending from the opposed, axially parallel edges of the backwall forward toward the radiators 12. The backwall 16 may be formed of a solid sheet of conductive, reflecting material or as a grid, the latter construction being illustrated in FIG. 1. Also, the sidewalls 18 may be formed of a solid sheet of conducting, reflecting material or as a set of slats or vanes, as shown in FIG. 1.

Figure 1A:
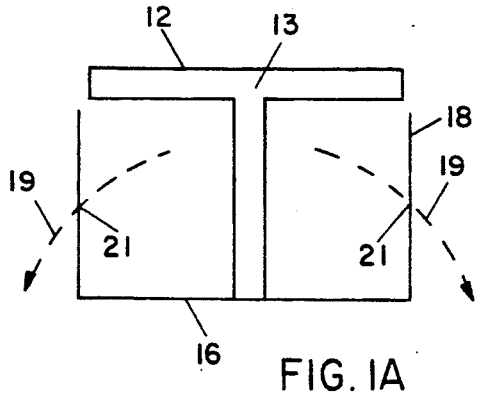
FIG. 1A is an end view of the antenna shown in FIG. 1.

Referring to FIG. 1A, an end view of the antenna 10 is shown. For a linearly polarized antenna such as antenna 10, the E-plane is defined as the plane containing the electric field vector and the direction of maximum radiation. Sidewalls 18 are referred to as E-plane backlobe suppressors. This is because energy from dipoles 12 which tends to radiate backward around backwall 16 will generally radiate in a direction as indicated by dotted arrows 19, and this direction lies in the E-plane. At the point 21 where sidewalls 18 intersect with the E-plane backward radiation, sidewalls 18 will reflect or block a maximum portion of the E-plane backlobe and sidelobe radiation. Therefore, sidewalls 18 would generally be located parallel to axis 13 and perpendicular to backwall 16.

Figure 2:
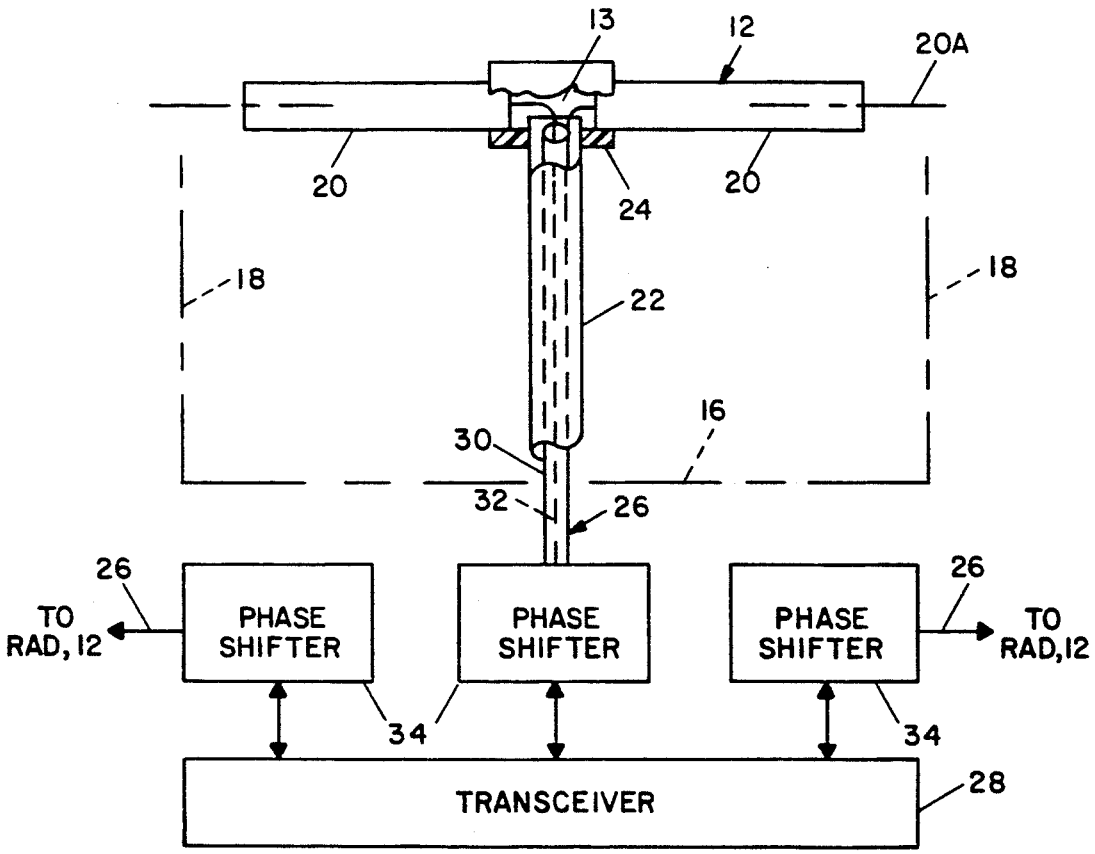
FIG. 2 is an enlarged diagrammatic view of a dipole radiator of FIG. 1 in the connection of the radiators to external electrical circuitry.

With reference to FIG. 2, each of the radiators 12 is formed of a pair of transversely extending rods 20 secured to a central post 22 by an electrically insulating coupling 24. Rods 20 are fabricated of an electrically conducting material such as copper or aluminum, and are insulated from each other by coupling 24. In each of the radiators 12, the rods 20 lie along a common axis 20A which is parallel to the plane of the backwall 16 and perpendicular to the planes of the sidewalls 18. Preferably, the rods 20 are spaced one-quarter wavelength of the free-space radiation from the backwall 16. In the most general case, the rods 20 are to be spaced an odd number of quarter wavelengths from the backwall 16 such that an electromagnetic wave radiating from a rod 20 reflects off the backwall 16 with a reversal in the sense of the electric field to provide a cophasal summation with the component of the wave radiating from the rod 20 in the forward direction. The posts 22 are of equal length so that the rods 20 of the respective radiators lie with their axis 20A in a common plane and intersecting the linear axis 13 of the array.

The extension of the sidewalls 18 from the backwall 16 brings the front edge of the sidewalls 18 to a location adjacent to and behind the common plane of the rods 20. While two, three or more of the radiators 12 may be employed in the construction of the antenna 10, the embodiment as illustrated in FIG. 1 employs three of the radiators 12. The width of the backwall 16 may be slightly larger than the lateral extent of the rods 20 such that the sidewalls 18 lie outside of the rods 20 by a small fraction of a wavelength, typically, less than approximately 1/10 of a wavelength. Although the sidewalls 18 are illustrated as a planar construction such as slats or a conductive plane, it is also contemplated that the sidewalls 18 may also be rods, a grid or any other conventional and well known reflecting structure.

Figure 3:
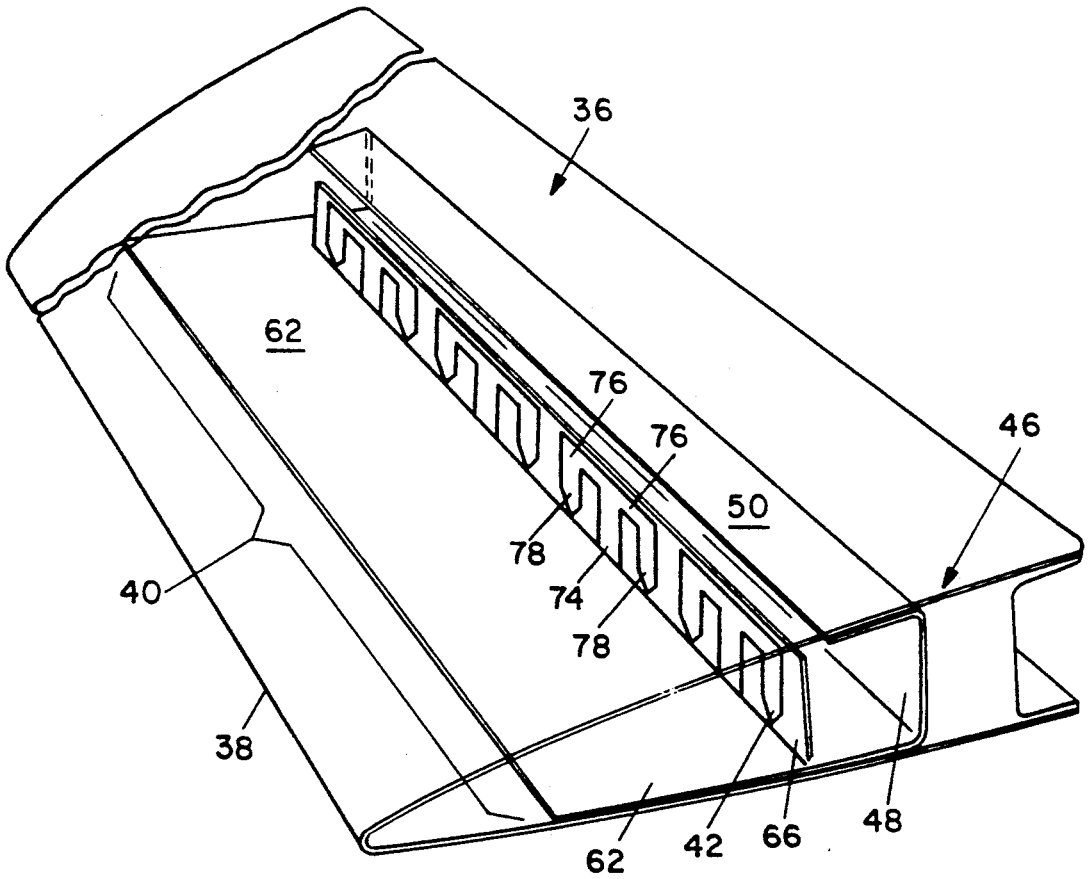
FIG. 3 shows a second embodiment of the invention suitable for mounting within an aircraft wing.

FIG. 3 shows a second embodiment of the invention wherein antenna 36 is provided with a configuration which fits within an air foil, particularly a wing 38 of an aircraft. To facilitate the illustration of the details of the construction of the antenna 36, the wing 38 is partially shown in a stylized view. The antenna 36 is shown in perspective view and forms a radiating aperture 40. Antenna 36 includes folded monopole radiators 42 perpendicularly mounted on an imaging ground plane 62. Located behind the monopoles 42, which form a linear array, is a reflector 46 which serves as a shield for inhibiting the propagation of electromagnetic energy in directions opposite the aperture 40. The reflector 46 comprises a backwall 48 and a short sidewall 50 parallel to the imaging plane 62 and perpendicular to the backwall 48. Sidewall 50 extends forward from a top edge of the backwall 48. Sidewall 50 is generally parallel to the upper surface of the wing 38. The imaging ground plane 62 is generally parallel to the lower surface of the wing 38. The radiators 42 are supported by a dielectric substrate 66. Each radiator 42 is constructed as a double-folded monopole radiator and is formed of metallic foil disposed on the front surface of substrate 66. Substrate 66 is secured to imaging ground plane 62 by conventional means, such as brackets (not shown).

Each of the monopole radiators 42 comprises a central leg 74 and a pair of wings 76 which extend perpendicular to and outward from the top of leg 74. Each wing includes an arm 78 which extends downward from the wing 76 and parallel to the central leg 74. The end of central leg 74, opposite the connection to wings 76, serves as a feed and connects with a transceiver (not shown) for transmission and reception of electromagnetic energy via the radiator 42. A microstrip feed network located on the backside of substrate 66 may be connected to the transceiver and used to feed the central leg 74.

Figure 4:
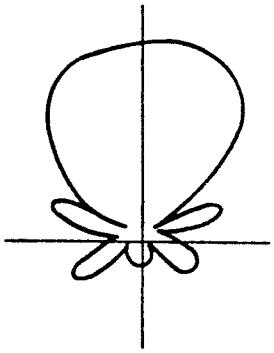
FIGS. 4 and 5 are illustrations of the patterns of the antennas shown in FIGS. 1 and 3.
Figure 5:
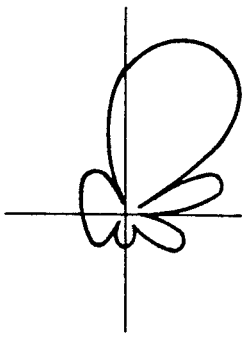

FIG. 4 shows a radiation pattern for the antenna 10 of FIG. 1, as viewed from the side of the antenna 10. FIG. 5 shows the corresponding pattern for the antenna 36 of FIG. 3. In both the patterns of FIGS. 5 and 6, radiation is emitted toward the front of the antenna with little or no radiation being emitted in the reverse direction. In addition, the shape of the beam and direction of the beam can be adjusted by selection of phase shift in a well known manner to the respective radiating elements, each of which is an active element providing a contribution of signal from individual signal sources for production of the resultant beam of radiation.

The two embodiments of the invention, namely, the antenna 10 of FIG. 1 and the antenna 36 of FIG. 3, demonstrate the utility of the invention for fixed and mobile applications. In the fixed application, the reflector 14 and the posts 22 of the radiators 12 may be secured to a hollow tubular support 104 which carries the coaxial cables 26, the support 104 having an aperture 106 which the coaxial cables 26 exit for connection with phase shifters 34 (FIG. 2). The support 104 terminates in a base 108 which holds the antenna steady. In a corresponding way, the wing 38 of FIG. 3 serves as a support for the components of antenna 36.

What is claimed is:

1. A monopole antenna system with a radiation pattern primarily directed in a forward direction and a limited overall width in a transverse E-plane direction, having a composite reflector for providing operation with reduced E-plane back radiation, comprising:

an imaging ground plane section having a reflective surface substantially perpendicular to said transverse E-plane direction;

a plurality of monopole radiating elements spaced in a longitudinal direction transverse to said forward and transverse E-plane directions, each said element including a radiating segment extending in said transverse E-plane direction from a coupling point proximate to said reflective surface outward from said reflective surface to a furthermost point, for providing a free space radiation pattern having a low field strength region outward from said furthermost points of said plurality of elements; and a composite reflector including:

a backwall section positioned behind said radiating segments and having a backwall width in said transverse E-plane direction substantially equal to said limited overall width of the antenna system, said backwall section terminating on one side at said reflective surface and on the other side in a backwall edge extending in said longitudinal direction; and sidewall means, coupled along said backwall edge of said backwall section and extending forward substantially perpendicularly to said radiating segments and terminating in a longitudinally extending composite reflector edge, for positioning said composite reflector edge behind, and outward in said transverse E-plane direction from, said furthermost points in said low field strength region;

whereby, said composite reflector is effective to reduce E-plane back radiation as compared to a back reflector of similar width in said transverse E-plane direction, while having an overall width in said transverse E-plane direction approximately the width of said backwall section alone.

2. A monopole antenna system in accordance with claim 1, wherein said backwall section has a backwall width in said transverse E-plane direction such that said backwall edge lies outward from said furthermost points of said radiating segments by less than one-half the average operating wavelength.

3. A monopole antenna system in accordance with claim 1, wherein said backwall section is substantially rectangular with a flat reflective surface and said sidewall means is attached along and extends forward from said backwall edge, so that said limited overall width of the antenna system is not significantly greater than said backwall width in said transverse E-plane direction.

4. A monopole antenna system in accordance with claim 1, wherein each said radiating element is a monopole extending substantially perpendicularly to said imaging ground plane section.

5. A monopole antenna system in accordance with claim 1, wherein said backwall section forms a continuous flat planar backwall which is connected along its said one side to said imaging ground plane section, and said sidewall means forms one continuous flat planar sidewall connected along said backwall edge of said backwall section.

6. A monopole antenna system in accordance with claim 1, wherein each said radiating segment has two oppositely extending wing portions extending in said longitudinal direction, each said wing portion terminating in an arm portion extending to said imaging ground plane section.

7. A monopole antenna system in accordance with claim 1 wherein:

said imaging ground plane section is substantially rectangular with a planar reflective surface extending in said forward direction from said backwall section to a termination forward of said monopole radiating elements in said forward direction;

said backwall section is substantially rectangular with a planar reflective surface attached along and extending substantially perpendicularly in said transverse E-plane direction from said imaging ground plane section; and said sidewall means is substantially rectangular with a planar reflective surface attached along said backwall edge and extending forward substantially perpendicularly to said backwall section;

whereby, said planar reflective surfaces of said imaging ground plane section and sidewall means extend forward substantially parallel to each other and are separated in said E-plane direction by said backwall width of said backwall section.

8. A monopole antenna system with a radiation pattern primarily directed in a forward direction and a limited overall width in a transverse E-plane direction, having a composite reflector for providing operation with reduced E-plane back radiation, comprising:

an imaging ground plane section having a reflective surface substantially perpendicular to said transverse E-plane direction;

a plurality of monopole radiating elements spaced in a longitudinal direction transverse to said forward and transverse E-plane directions, each said element including a radiating segment extending in said transverse E-plane direction from a coupling point proximate to said reflective surface outward substantially perpendicularly from said reflective surface to a furthermost point; and a composite reflector including:

a substantially rectangular backwall section positioned behind said radiating segments and having a backwall width in said transverse E-plane direction substantially equal to said limited overall width of the antenna system, said backwall section terminating in two side edges extending in said longitudinal direction, one said side edge being coupled along said reflective surface of said imaging ground plane section and the other said side edge comprising a backwall edge lying outward in said transverse E-plane direction from the furthermost points of said radiating segments by less than one-half of the average operating wavelength; and a sidewall section coupled along said backwall edge of said backwall section and extending forward substantially perpendicularly to said radiating segments and terminating in a longitudinally extending composite reflector edge, said composite reflector edge positioned behind, and outward in said transverse E-plane direction from, said furthermost points;

whereby, said composite reflector is effective to reduce E-plane back radiation as compared to a back reflector of similar width in said transverse E-plane direction, while having an overall width in said transverse E-plane direction approximating the width of said backwall section alone.

9. A monopole antenna system in accordance with claim 8, wherein said backwall section is substantially rectangular with a flat reflective surface and said sidewall section provides a substantially rectangular flat reflective surface attached along and extending forward from said backwall edge of said backwall section, so that said limited overall width of the antenna system is not significantly greater than said backwall width in said transverse E-plane direction.

10. A monopole antenna system in accordance with claim 8 wherein:

said imaging ground plane section is substantially rectangular with a planar reflective surface extending in said forward direction from said backwall section to a termination forward of said monopole radiating elements in said forward direction;

said backwall section is substantially rectangular with a planar reflective surface attached along and extending substantially perpendicularly in said transverse E-plane direction from said imaging ground plane section; and said sidewall section is substantially rectangular with a planar reflective surface attached along said backwall edge and extending forward substantially perpendicularly to said backwall section;

whereby, said planar reflective surfaces of said imaging ground plane section and sidewall section extend forward substantially parallel to each other and separated in said transverse E-plane direction by said backwall width of said backwall section.

11. A monopole antenna system in accordance with claim 8, wherein each said radiating segment has two oppositely extending wing portions extending in said longitudinal direction, each said wing portion terminating in an arm portion extending to said imaging ground plane section.

12. A monopole antenna system in accordance with claim 8, wherein said reflective ground plane section and sidewall section are shaped to fit within airfoil surfaces of a wing of an aircraft and the monopole antenna system is proportioned and shaped to fit and operate within said wing of the aircraft.

* * * * *